United States Patent [19]

Shabram, Jr. et al.

[11] Patent Number: 4,608,797

[45] Date of Patent: Sep. 2, 1986

[54] AUTOMATIC PACKAGING MACHINE

[75] Inventors: Lyle F. Shabram, Jr., 71 Rancho Rd., Carmel Valley, Calif. 93924; Jeff Shabram, Carmel, Calif.; Paul Shabram, Monterey, Calif.; Kevin Shabram, Carmel, Calif.

[73] Assignee: Lyle F. Shabram, Jr., Carmel Valley, Calif.

[21] Appl. No.: 752,571

[22] Filed: Jul. 8, 1985

[51] Int. Cl.[4] ..... B65B 1/30

[52] U.S. Cl. ..... 53/504; 53/550

[58] Field of Search ..... 53/550, 551, 450, 451, 53/51, 504, 373, 75

[56] References Cited

U.S. PATENT DOCUMENTS

| | | | |
|---|---|---|---|
| 2,959,901 | 11/1960 | Conti | 53/550 X |
| 3,001,348 | 9/1961 | Rado | 53/550 |
| 3,237,371 | 3/1966 | Gerlach | 53/550 X |
| 3,388,526 | 6/1968 | Harm et al. | 53/550 X |
| 3,693,319 | 9/1972 | Hunsader | 53/550 X |
| 4,009,551 | 3/1977 | Greenawalt et al. | 53/51 X |
| 4,067,170 | 1/1978 | Yates, Jr. | 53/51 X |
| 4,506,488 | 3/1985 | Matt et al. | 53/550 X |

*Primary Examiner*—Horace M. Culver

*Attorney, Agent, or Firm*—Hamrick, Hoffman, Guillot & Kazubowski

[57] ABSTRACT

A machine for continuously packaging/bagging articles within a thermoplastic film, includes a microprocessor cued by magnetic encoder wheels for coordinating intermittent advancement of a film web by a continuous side sealing mechanism with operation of a bar sealing mechanism across the film web. The machine is tiltable between horizontal and vertical positions on a pivoting base for allowing gravity infeed of the articles being packaged/bagged.

9 Claims, 13 Drawing Figures

AUTOMATIC PACKAGING MACHINE

BACKGROUND OF THE INVENTION

1. Field of the Invention: The invention relates to a machine for continuously wrapping, packaging, and/or bagging articles within thermoplastic films (polybags, shrinkwraps, and the like).

2. Description of the Prior Art:

A large variety of sealing and product handling equipment exists for wrapping, packing and/or bagging articles within plastic films. The primary problems with such existing equipment relate to (1) large physical size, (2) lack of versatility in wrapping/bagging different size articles, (3) inability to dimension the wrapping or bag to that of the enclosed article, (4). speed of operation, (5) adaptability for automated operation, (6) inability to consistently obtain a high integrity seal between two layers of film where several different varieties of thermoplastic films are used in the equipment.

For example, "L"—sealers are slow, require the use of centerfold film, cannot produce close fitting packages and can only be partially automated.

U.S. Pat. No. 3,340,776 describes a packaging machine developed by our father which pioneers the field of equipment for automatically packaging articles in plastic films. However, the machine developed by our father does not solve many of the problems in obtaining "close fitting seals". His machine also cannot control package size without reference to the item to be packaged. Finally, his machine cannot consistently provide high integrity weld type seals for all varieties of thermoplastic film.

SUMMARY OF THE INVENTION

A machine for continuously wrapping, packaging and/or bagging articles within a thermoplastic film is described which includes a microprocessor system cued by magnetic encoder wheels which track web travel and rotational position of a transverse sealing bar mechanism, for coordinating intermittent advance of the film web by a continuous side sealing mechanism with engagement of the transverse sealing bar mechanism across the web as it moves through the machine.

One of the aspects of the invented machine is a pivoting base which allows the machine to be tilted between a horizontal to a vertical position, thus enabling the film to either convey the article prior to being packaged (horizontal position) or to receive it from a gravity chute (tilted position).

Still another aspect of the invented machine relates to curved gripping surfaces on the transverse bar sealing mechanism which stretch and flatten the film layers as they are welded together to provide a better weld and a tighter fitting package/bag.

Still another advantages of the invented machine relate to an ability to program dwell time for both the side sealing and the transverse bar sealing mechanism to the type of thermoplastic film thereby enabling one to consistently obtain high integrity seals. Such programmed dwell time is also allows the side and the transverse bar sealing components to absorb the shock of gravity fed articles and materials.

Another feature of the invented machine relates to integral film folding planes on the machine frame for folding wide films longitudinally as they are unrolled from a roll mountable on the machine frame.

Still other features, aspects, advantages and objects of the invented machine for continuously packaging, wrapping and/or bagging various articles will become apparent and/or be fully described and understood with reference to the following description and detailed drawings.

DETAILED DESCRIPTION OF A PREFERRED EMBODIMENT

Figure 1:
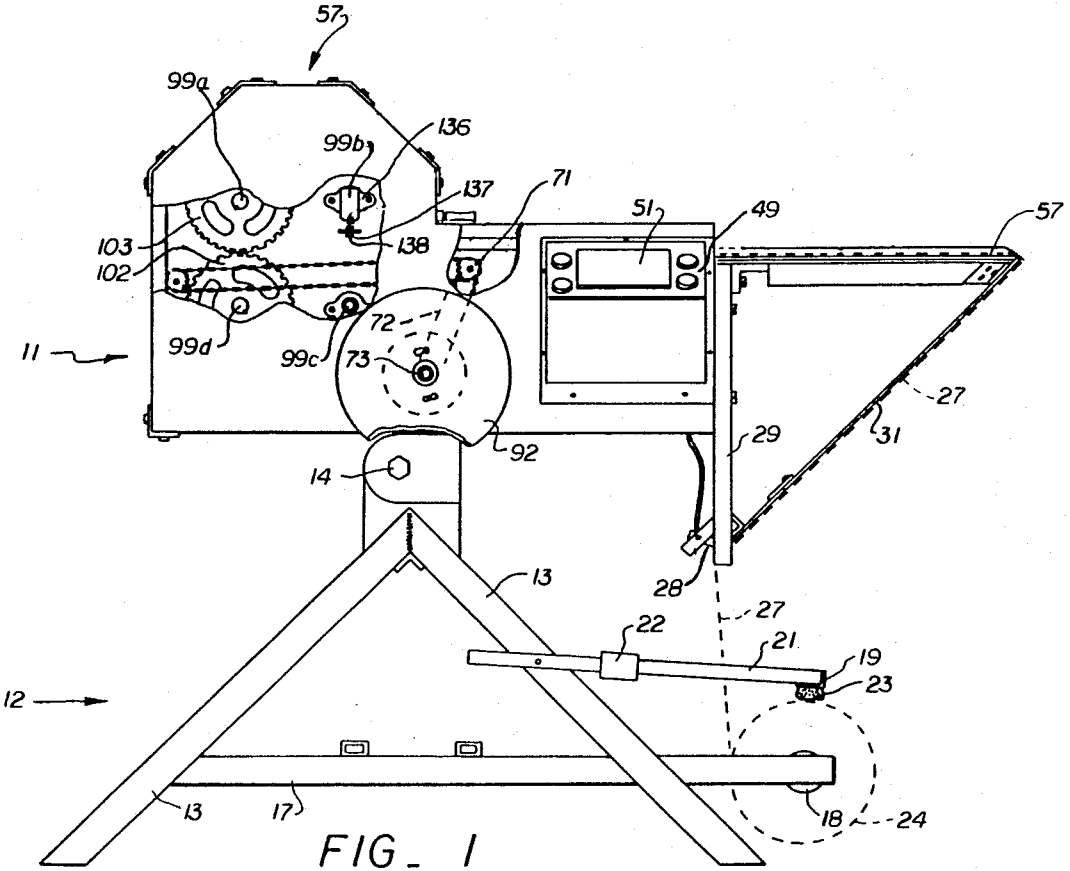
FIG. 1 is a left side elevation cut away view of the invented machine illustrating the driving mechanism.
Figure 2:
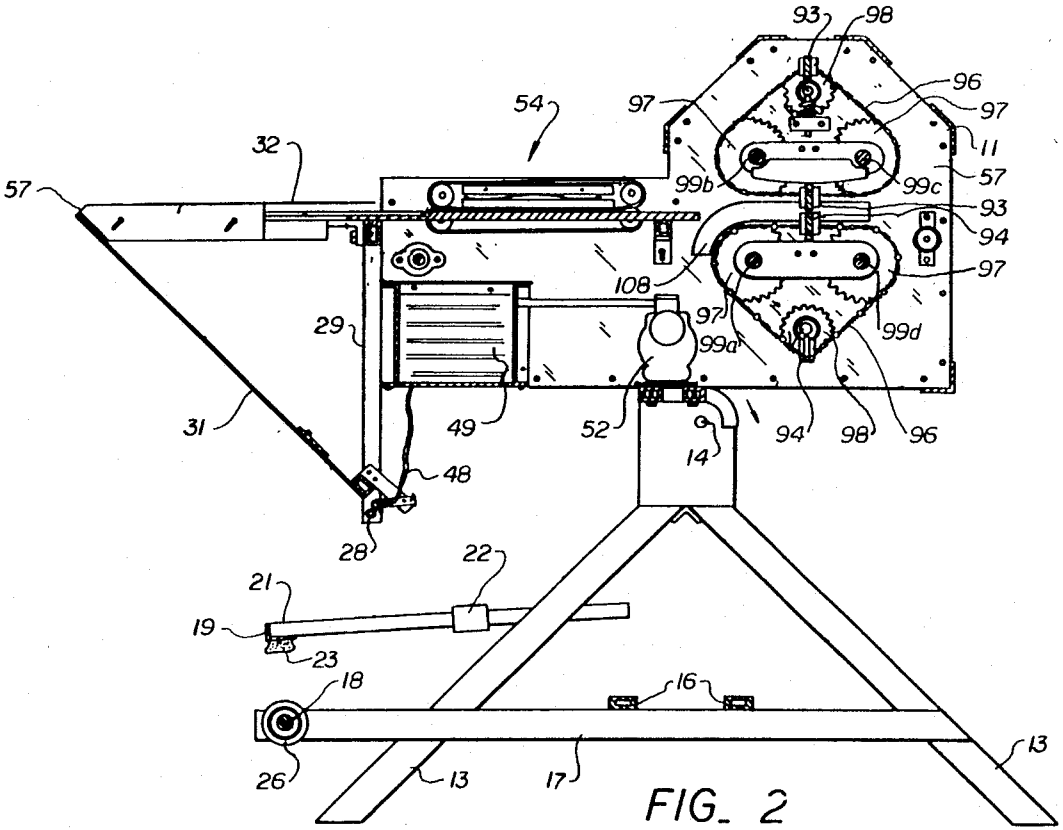
FIG. 2 is a longitudinal cross sectional view of the invented machine showing the sequential relationship of various of its components.
Figure 3:
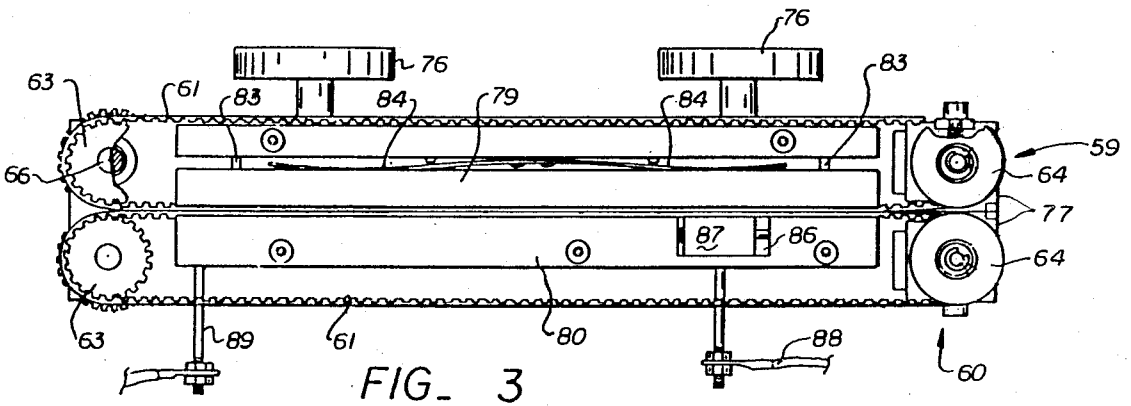
FIG. 3 is a cut away side view of the side sealing mechanism of the machine.

Referring to FIGS. 1 and 2, the invented automatic packaging machine includes a machine frame 11 and a base frame 12. Legs 13 of the base frame 12 are joined to form two right angle pairs.

A conventional pivoting mechanical coupling 14 secures the machine frame to the base frame at the right angle vertex defined by the legs 13. The base frame 12 further includes cross-frame braces 16 parallel to the pivoting couples 14 and a leg brace 17. One end of each leg brace 17 extends to the exterior of the prismatic volume defined by the base frame legs 13 for rotatively supporting an idler roller rod 18. A tensioning bar 19 is supported between two tension arms 21 each mounted to one leg 13 of the joined pair of legs. The tension arms 21 extend from the same side of the base frame as do the leg braces 17. A pair of weights 22 are slidibly mounted on the tension arms 21. A friction pad 23 (usually foam rubber) is secured to the underside of the tensioning bar 19.

A roll of thermoplastic film 24 is supported by and rotates the idler rod 18. The tensioning bar 19 is adapted to pivot downwardly, such that the friction pad 23 engages the surface of the roll 24 to provide frictional resistance as the thermoplastic film is unwound from the roll 24. The degree of frictional resistance can be determined and adjusted by sliding the weights 22 back and forth along the length of the tension arms 21. Conventional hubs 26 maintain the thermoplastic film roll 24 coaxial with the idler rod 18.

The planar web of thermoplastic film 27 unwinds from the roll 24 and is trained around a roller 28 rotatably supported between a pair of arms 29 extending downwardly from the machine frame 12. The roller 28 maintains the web 27 flatly against a first former face 31 of the film folding planes, which is inclined relative to the plane of travel through the machine frame 11.

Figure 13:
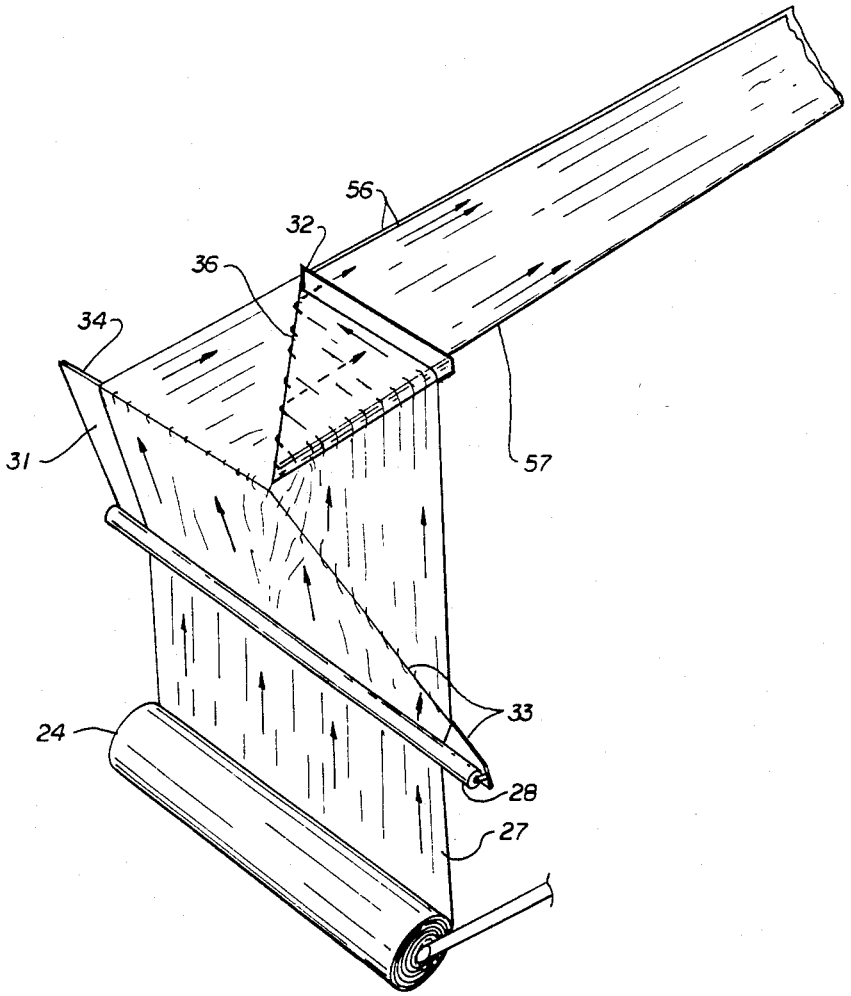
FIG. 13 is a perspective view of the folding plane plates for folding a film web in half.

In particular, referring also now to FIG. 13, showing the the film folding plane plates, the film web 27 is drawn across the first former face 31 and a second "bent" former face 32 such that the sheet or web 27 as unrolled from the roll 24 is folded over itself in half as it travels through the machine. The first former face 31 has an inclined edge 33 around which approximately ½ of the width of the film is trained. The remaining width of the film is trained over the top edge 34 of the former face 31 which is perpendicularly oriented with respect to the direction of film travel through the machine. In essence, the film web 27 reverses direction as it moves around the respective edges 33 and 34 of the first former face. The portion of the film web 27 trained around the inclined edge 33 of the first former face 31 is then trained around the inclined edge 36 of the bent former face 32 which is inclined angularly above the portion of the film web 27 trained around the top edge 34 of the first former plate 31. In this manner, the film web 27 is folded in half over itself. The use of folding plane plates to fold a film web over onto itself is generally well known and conventional in the industry.

The roller 28 maintains the film web 27 adjacent and parallel to the face of the first former plate 31 regardless of the tilted position of the machine frame relative to the axis of the idler roll bar and associated thermoplastic film roll 24 mounted thereon.

Figure 12:
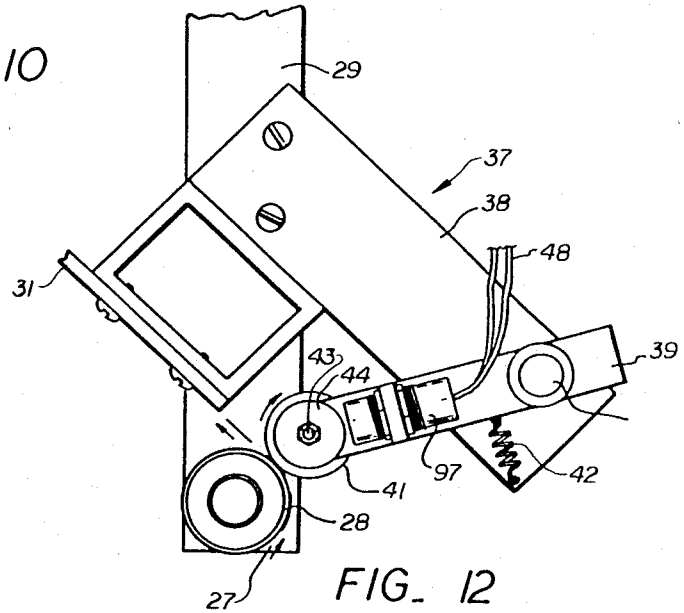
FIG. 12 is an enlarged cross-sectional view illustrating details of the package length encoder wheel assembly following film travel.

Referring now to FIG. 12, a length encoder wheel assembly 37 is mounted on one of the arms 29 extending down from the machine frame 11. The assembly 37 includes a bracket 38, secured to the downwardly extending arm 29, a wheel mounting arm 39 pivotably secured to the bracket 38 and a rubber driving wheel 41 rotatably mounted at the distal end of the mounting arm 39. A spring 42 biases the mounting arm 39 to maintain engagement of the rubber driving wheel 41 with the periphery of the roller 28. The film web 27 is received between the roller 28 and the rubber driving wheel 41. The rubber driving wheel is coupled by a shaft 43 through a one-way bearing (not shown) to a magnetic encoder wheel 44. The one-way bearing ensures that the film web 27 is not drawn backwardly around the roller 28 due to an unbalanced roll or resiliency of the film web 27. The one-way bearing also ensures that the magnetic encoder wheel 44, does not rotate backwardly.

Figure 11:
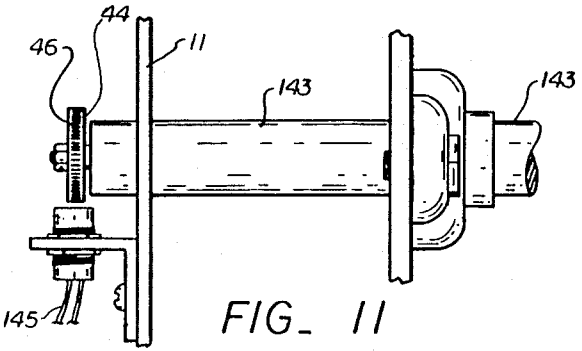
FIG. 11 is a enlarged cross-sectional view of the clocking encoder driven synchronously with the transverse bar sealing mechanism.

In more detail, referring to FIG. 11, the magnetic encoder wheel 44 includes on its periphery a plurality of equally spaced magnetic remains indicated schematically as dots 46. The magnetic regions 46 should be of the same same polarity such that the magnetic field provided by each region is distinct and separate from that provided by the adjacent regions. The magnetic regions 46 can be provided by radially mounting a plurality bar magnets such that one pole of magnet extends to the surface of the wheel.

A magnetic field sensor 47 is mounted on the wheel mounting arm 39 of the length encoder assembly 37 for generating an electrical current pulse each time a magnetic region 46 traverses across its face carried by the encoder wheel 44. In this fashion, at unit length of webbed film 27 drawn from the roll 24 will generate a specific number of current pulses. By appropriately dimensioning the diameter of the rubber driving wheel 41 with respect to the number of magnetic regions 46 on the periphery of the magnetic encoder wheel 44, the relationship between the length of film drawn, "L" and the number of current pulses generated, "N" can be precisely determined. For example, the rubber driving wheel 41 could be sized for generating one pulse for every centimeter of travel of the web film 27.

The current pulses generated from the sensor 47 are conducted by conventional wiring 48 to a microprocessor system shown generally at 49. (FIG. 1)

In more detail, the microprocessor system 49 basically comprises a conventional electronic computer that includes a processor, a programmable read only memory, a random access memory and an eraseable programmable read only memory all electrically interconnected in a conventional manner. The system includes a conventional input key board 51 through which an operator can input appropriate control algorithms and date. The system 49 may also include a conventional magnetic disk drive or magnetic tape program/data mechanism for inputing the control algorithims and data. The microprocessor system 49 may also include a conventional display mechanism for displaying the parameters input into the system such as a CRT, LED, LCD and/or EFB display system.

The microprocessor system 49 controls two electric moters 52 & 54 utilizing the algorithims and data input into the system and the electrical pulses received from the encoder wheel assemblies shown at 37 and in FIGS. 11 and 12. The motor 52 drives a mechanism 54 which simultaneously seals the folded together longitudinal edges 56 of the film web 27 while intermitently advancing the folded film web 27 through the machine. The motor 53 drives the transverse sealing mechanism 57 which simultaneously seals the ends and severs each packaged/bagged article from the continuous film web 27.

The articles to be packaged/wrapped and/or bagged are received on the input table 57 of the machine just forward of the inclined edge 36 of the bent former plate 32. When the machine frame 11 is horizontally oriented, the folded film web 27 will carry or convey the article into and through the machine.

Referring now to FIGS. 2, 3, 4 and 5, the side sealing mechanism or assembly 54 consists of an upper sub-assembly 59 and a lower sub-assembly 60. The upper assembly 59 is removable to permit cleaning and maintenance. The sub-assemblies 59 and 60 each include a narrow and a wide non-slip or timing belt 61 and 62 respectively trained around a head pully 63 and a tail pully 64. The pullys 63 and 64 are each configured for positively engaging a cleated under surface of the respective timing belts 61 and 62. The head pullies 63 of the upper assembly 59 are journaled to a common shaft 66 which in turn is rotatably driven by a driving gear 67. Similarly, the head pullies 63 of the lower sub-assembly 60 are journaled to a common shaft 68 which in turn is rotatably supported by a bearing block 69 mounted in the machine frame 12. A chain driven pully 71 is journaled to the distal end of the shaft 68 extending through the side of the machine frame 11. (see FIG. 1) A chain 72 couples the chain pully 71 to the output shaft 73 of the side seal motor 52. A driving gear 74 is also keyed to the shaft 68.

The upper sub-assembly 59 is secured to the lower sub-assembly 60 by a pair of set screws 76 such that the driving gear 67 keyed to the shaft 66 engages the driving gear 74 keyed to the shaft 68. When the sub-assemblies 59 and 60 are fastened together the respective exterior surfaces of the belts 61 and 62 are compressed together and move without relative longitudinal slippage at their interfaces.

In order to maintain appropriate tension for the belts 61 and 62, the shafts for the tail pullys 64 are carried in belt tensioning adjustment blocks 77 which are adapted to slide longitudinally relative to the frame of the respective sub-assemblies 59 and 60. An appropriate securing mechanism such as an adjustment screw 78 secures the blocks 77 after appropriate adjustment creating tension for the belts 61 and 62.

Received within the frame work of the upper and lower sub-assemblies 59 and 60 are two pressure shoes 79 and 80. The pressure shoes 79 & 80 have guide tracks 81 and 82 for receiving the narrow and wide belts 61 and 62 respectively. The upper pressure shoe 79 is adapted to slide up and down relative to the frame work of the upper sub-assembly 59 on a pair of pins 83. A leaf spring 84 biases the upper pressure shoe 79 downwardly relative to the frame work of the upper sub-assembly 59, providing the compressive force pressing the respective belts 61-61 and 62-62 together. The folded together longitudinal edges 56 of the film web 27 (See FIG. 13) are received between the respective belts of the uppper and lower sub-assemblies 59 and 60.

The upper shoe 79 includes a longitudinal slot 84 between the guide tracks 81 and 82. A sealing ribbon or wire 86 is mounted between the guide tracks 81 and 82 of the lower shoe.

Figure 5:
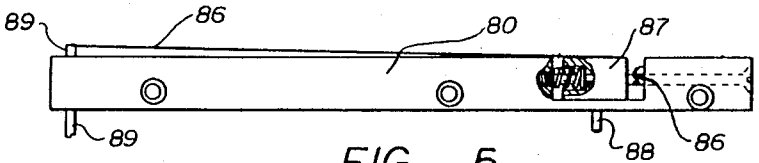
FIG. 5 is a side view of the lower pressure shoe of the side sealing mechanism illustrating the sealing wire assembly.
Figure 4:
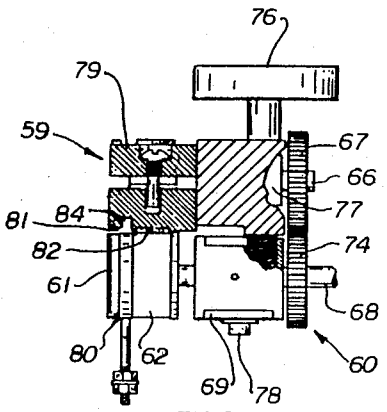
FIG. 4 is a cut away cross section input end view of the side sealing mechanism.

In more detail, referring to FIG. 5, the lower pressure shoe 80 includes a relieved section 86 for receiving a slideable and spring tensioned electrically insulative ribbon block 87 which includes an electrical connecting means 88 for connection to the sealing ribbon 86. At the discharge end of the lower pressure shoe 80 the sealing ribbon 86 is secured to an insulated connector rod 89 which extends above the plane defined by the face of the shoe 80. Accordingly, the longitudinal edges 56 of of the film web 27 held between the respective belts 61 and 62 encounter the sealing ribbon or wire 86 as the belts 61 and 62 advance the film web through the side sealing mechanism 54. The sealing wire 86 is heated by conducting an electrical current through it via the connectors 88 and 89. A spring 91 compressed between the body of the lower shoe 80 and the ribbon block 87 maintains the tension of the sealing wire as it expands and contracts. By slightly diverging the track of the wide belts 62-62 relative to that of the narrow belts 61-61 the portion of the film web secured between the wide belts is pulled away from the remainder of the film web 27 held between the narrow belts 61. The heated wire or sealing ribbon not only creates a seal between the upper and lower longitudinal edges of the film web 27, it also excises and separates the excised portion of the longitudinal edge 56 of the film web. The excised portion of the film web 91 is received and wound about a reel 92 (see FIG. 1) also driven by the side seal motor 52 through a friction clutch (not shown).

A very high integrity seal is provided by the described side sealing mechanism 54 in that the respective belts 61 and 62 do not permit relative lateral movement between the respective longitudinal edges 56 of the folded over film web 27. In particular, the belts travel at exactly the same speed. The compression provided by the leaf spring 85 urging the upper shoe 79 downardly essentially eliminates slippage between the respective surfaces of the film and respective pairs of belts 61 and 62 of the upper and lower shoes.

The side sealing mechanism 54 creates an endless film tube containing the articles being packaged/wrapped/-bagged. To complete the packaging/wrapping/bagging of such articles, the ends of each section of the tube enclosing one article must be sealed and severed from the remainder of the tube. This is accomplished by the end seal mechanism 57.

In particular, referring now to FIGS. 1, 2 6 and 7–10 of the drawings, the end sealing mechanism 57 basically comprises at least one pair of transverse bars traveling synchronously in the same direction above and below the film tube. Each bar is carried by a parallel pair of timing chains 96, each trained around at least two sprockets 97 and an idler sprocket 98 on either side of the machine frame 11. The corresponding sprockets 97 are keyed to common shafts 99. The shafts 99 are journaled in bearings mounted in the machine frame. One of the shafts 99 D, extends through the machine frame 11. A drive sprocket 101 is keyed to the extending end of the shaft 99 D and a gear wheel 102 is keyed to the other end of the shaft 99 D. A sprocket chain drive 103 couples the drive sprocket 101 to the end seal motor 53. A follower gear 103 exactly the same size as the gear wheel 102 is mounted on the distal end of one of the shaft 99 A carrying a pair of the upper sprockets 97. The follower 103 engages and is driven by the gear wheel 102. Accordingly, the combination of the timing chains 96 trained around the respective sets of sprockets 97, and idlers 98 cause the shafts 99C and D to rotate in one direction and shafts 99 A and B to rotate in the opposite direction such that upper transverse bar 93 and the lower transverse bar 94 are synchronously carried by the respective timing chains 96 into engagement across the web film tube. The respective timing chains 96 of the upper and lower end sealing assemblies may carry more than one transverse bar. For example, as shown in FIG. 2, each pair of timing chains 96 carries two transverse bars.

Figure 7:
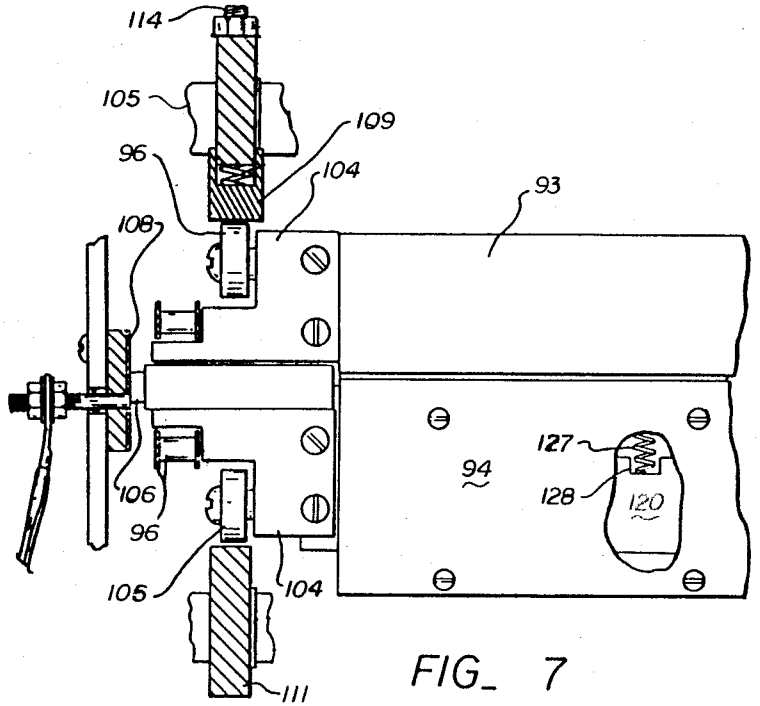
FIG. 7 is a detail cross-sectional view illustrating the transverse bar seal, the bar pressure shoes and the electrical brush contact assembly.

Referring now to FIG. 7, the transverse sealing bar assemblies 93 and 94 include at each of their respective ends a chain mounting block 104 securing an end of a particular bar 93/94 to a particular timing chain 96. Each chain mounting block includes a roller bearing 105. The chain mounting block 104 for the lower bar 94 also includes a brush contact 106 for establishing an electrical connection between a sealing wire or ribbon 107 carried within the lower transverse bar 94 and a contact plate 108 insulatedly mounted on the sides of the machine frame 11 and located for maintaining contact with the brushes 106 during a time period in which the upper transverse bar 93 and the lower transverse bar 94 are engaged. The bearing 105 of each chain mounting block 104 engages either an upper pressure shoe 109 or a lower pressure shoe 111. The upper pressure shoes 109 are moveably mounted to a support assembly 112 mounted on the shafts 99 A and 99 B by bearing supports 113. Upward translation upper pressure shoe 109 is resisted by a shoe adjustment stud 114 which includes spring 116 forcing the upper pressure shoe 109 downardly with respect to the mounting assembly 112. Each lower shoe 111 is rigidly supported by the shafts 99C and 99D by bearing supports 113 on each side of the machine frame 12. To avoid translation, the upper shoe mounting assembly 112 and the lower pressure shoe should also be secured to the sides of the machine frame 11.

As described the upper and lower sealing bars 93 and 94 can separate if the solid object is caught between the bars. Also, adjustment stud 114 in combination with the spring 116 allows an operator to adjust the engagement pressure of the upper and lower sealing bars for obtaining an optimum seal and severance of each section of the tubular web film.

Figure 9:
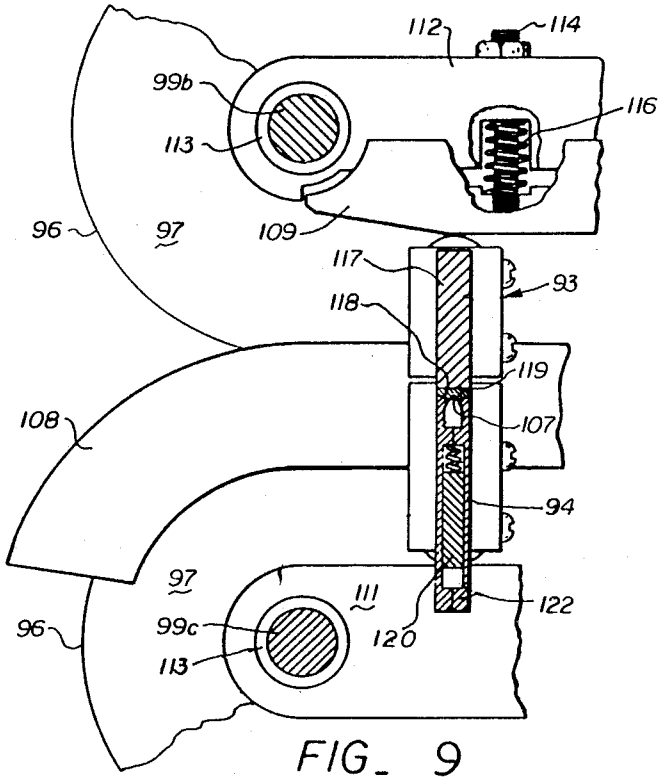
FIG. 9 is a cross-section view illustrating the relationship of the upper and lower bar pressure shoes and the upper and lower assemblies of the transfer bar sealing mechanism.
Figure 8:
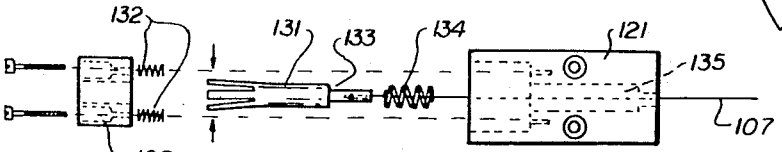
FIG. 8 is an exploded view of the brush contact assembly.
Figure 10:
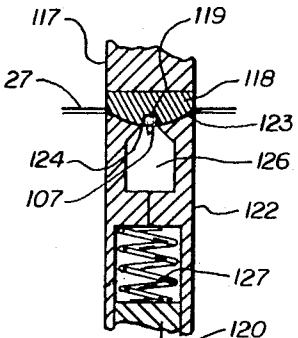
FIG. 10 is an enlarged cross sectional view illustrating the gripping or engaging surface of the transverse bars sealing mechanism.

Referring now to FIGS. 8, 9 and 10, the upper sealing bar 93 includes a main body 117 and a glued on sealing pad 118 preferably composed of silicone rubber. As shown in FIG. 10, the sealing pad 118 should have a convex cross sectional configuration with a longitudinal slot 119 at its highest point. The lower sealing bar 94 includes a central cross member 120 with two non-conductive blocks 121 secured to either of its ends connected to the chain mounting block 104. (see FIG. 8) A jacket assembly 122 translates up and down on the central cross member 120. The jacket assembly defines a concaved engagement surface 123 with a longitudinal sealing ribbon slot 124 which widens into a cavity 126, communicating from its lowest point. Below the sealing wire cavity 126, the jacket 122 snuggly but slidely engages the sides of the central cross member 120. A plurality of compression springs 127 are received in notches 128 cut into the top of the cross member 120 such that the jacket assembly 122 is resiliently supported above the cross member 120. Accordingly, when the convex sealing pad 118 of the upper ceiling bar 93 engages the concave engagement surface 123 of the jacket assembly 122, the jacket assembly translates downardly exposing the sealing ribbon or wire 107 to the layers web film 27 compressed between the engagement surfaces of the sealing pad 118 and of the jacket assembly 123.

The sealing wire 107 is stretched along the sealing wire cavity 126 and is heated by an electrical current conducted between the contact plates 108 on either side of the machine frame 11, via the brush contacts 106. Referring to FIG. 8, each brush contact 106 includes a central contact pin 131 which is split and pared to form a wide conical end such that a continuous movable electrical contact is made with the interior wall of a cylindrical aperture through the brush 106. Compression springs 132 bias or urged the brush outward from the insulated end piece 121 in order to maintain electrical contact with a contact plate 108 mounted on either side of the machine frame 11. The remaining end of the contact pin 131 is connected to the sealing wire or ribbon 107. The end contact pin is also relieved to provide an annular shoulder 133. A correspondingly shaped cavity is drilled through the end insulative piece 121. A compression spring 134 is compressed between the annular shoulder 133 of the contact pin 131 and the bottom of the larger diameter portion of the passage way 135 drilled through the insulated end piece 121. The compression spring 134 maintains tension on the sealing wire 107 to compensate for the thermal expansion and contraction as the wire 107 heats and cools during the machine cycles.

The curved engagement faces 118 & 123 provided by the upper and lower sealing assemblies 93 and 94 respectively stretch and flatten the film web tube 27 as the web is compressed between the surfaces. The adjustment stud 114 positioning the upper shoe 112 controls the downward translation of the jacket assembly 122 enabling precise positioning of the layers of film relative to the sealing wire 107. The compression springs 116 forcing the upper shoes 112 downwardly and the compression springs 127 supporting the jacket assembly 122 above the cross member 120 provide the necessary compression for stretching amd flattening the film layers together.

Figure 6:
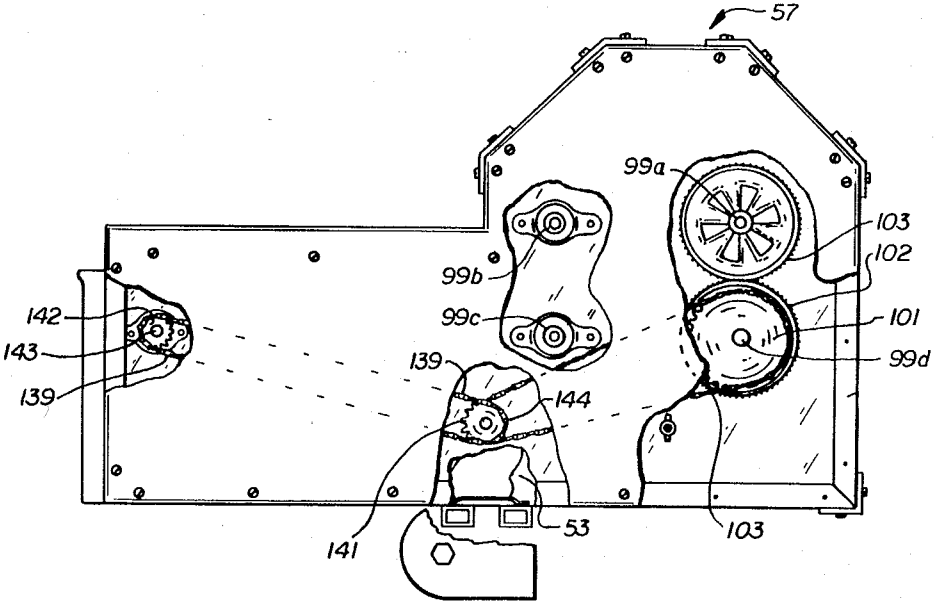
FIG. 6 is a left side elevation view illustrating the drive for the transverse bar sealing mechanisms.

Referring now to FIGS. 1, 6 and 11, the rotational position of the upper and lower sealing bars 93 and 94 are tracked by magnetic encoder wheels. In particular, keyed to the distal end of shaft 99b is a single pole encoder wheel 136. (FIG. 1) A magnetic field sensor 137 is mounted on the side of the machine frame 11 for generating an electrical current pulse responsive to the encoder wheel 136. One pulse is generated for every complete rotation of the encoder wheel 136. The electrical current pulse is conducted to the microprocessor 49 via wiring 138 (see FIG. 1). On the opposite side of the machine frame 11 a chain drive 139 is trained around a sprocket 141 driven by the end seal motor 53. (FIG. 6) The driven sprocket 142 in turn is journaled to a jack shaft 143. The jack shaft is supported or journaled in bearings supported by the sides of the machine frame 11. A magnetic encoder wheel 44 is keyed to the end of the jack shaft 143. By appropriately selecting the ratios of the sprockets 141 & 142 coupling the motor 53 to the encoder wheel and the sprockets 143 and 101 coupling the motor 53 to the shaft **99*d*, a precise relationship is maintained between the rotational position of the encoder wheel 44 and the rotational position of the upper and lower sealing bars 93 and 94 synchonously carried by the timing chains 96**.

In a particular embodiment, a relationship was selected such that the jack shaft 143 rotates four (4) times for every rotation of the drive sprocket 101. In this manner, the encoder wheel 44 makes four complete rotations for every rotation of the single pole encoder wheel 136 tracking rotation of the shaft **99*b***.

With the sealing bars mounted and equal distance apart on the timing chains 96, one rotation of the shafts 96 a–d occurs for each cycle of the end seal mechanism provided the chains 96 have twice as many links as the number of teeth of the sprockets 97. The rotational position of the encoder wheel 44 tracking rotation of the jack shaft 143 is monitored by a magnetic field sensor 144, which generates electrical current pulses responsive to the magnetic traversing its surface carried by the encoder wheel 44. The current pulses are transmitted to the microprocessor 49 through electrical wiring 145.

In operation, the magnetic encoder wheel 44 tracking the jack shaft 143 and the single pole encoder wheel 136 tracking the rotation of shaft 99 specify the rotational position of the synchronously engaging upper and lower sealing bars 93 and 94 carried by the respective timing chains pairs 96. For example, the current pulse generated by the single pole encoder wheel 136 as it passes by the magnetic fields sensor 137 can be used to reset a counter which counts the pulses generated by the magnetic field sensor 144 tracking the encoder wheel 44 keyed to the jack shaft 143.

In operation, a roll of thermoplastic film is mounted in the machine and a sheet pulled from the roll folded over the fold plane plates and fed into the side sealing mechanism. The machine is cycled to assure passage of the folded over web through the machine. An appropriate program is entered into the microprocessor which programs the length of the package/bag, the rate at which the side sealing mechanism advances the package through the system and the dwell time of the end sealing mechanism which severs and seals the articles from the continuous tube. The machine is then started and pulses from the magnetic sensor 47 are counted which correspond to the length of the article desired, as the belts of the side sealing mechanism advance the folded over film web into and through the machine. After a chosen number of counts, the advancement of the folded over film through the machine is paused to allow the end sealing mechanism to engage transversely across the film tube. It is also possible by appropriate control of the respective drive motors 52 & 53 to cause the upper and lower sealing bars 93 and 94 to be moving at exactly the same velocity as the film tube at the point where the film tube is engaged between the respective engagement surfaces of the upper and lower sealing bars.

It should also be appreciated, with reference to the numbers of pulses generated by the respective sensors 47, 137 and 144, that the microprocessor can cycle electrical current through the respective sealing ribbons 86 and 107 of the side seal and end seal mechanisms 54 and 57. Also, by appropriate reference to the number of current pulses generated by the respective sensors 47, 137 and 144 microprocessor can control the speed at which the upper and lower sealing bars 93 and 94 of the end seal mechanism 57 move or rotate. This speed can be increased at the end of the transverse sealing cycle to effectively pull a packaged article from the continuous tube. The heat of the sealing wire 107 seals the bottom of the following bag and the top of the bag being pulled from the tube. In this regard, care should be taken for maintaining sufficient dwell between the sealing ribbon 107 and the film web tube 27 to insure integrity of the end seal of the following package.

Furthermore, with reference to the number of pulses generated by the respective magnetic field sensors, the machine can be programmed to stop with the upper and lower sealing bars 93 and 94 engaged across the bottom of a bag such that one side of the bag remains between at least the narrow belts 61 of the upper and lower side sealing sub-assemblies 59 and 60, to allow a heavy article to be dropped into the bag from a gravity chute appropriately located in a plane co-extensive with the feed plane through the machine. (In such an instance, the machine frame 12 would be tilted above the horizontal relative to the base frame 12.) In this manner, the newly formed side seal is shielded from the mechanical shock as the article drops into the bag, while the upper and lower sealing bar of the end seal mechanism absorb the mechanical shock of the article sliding into the package.

The curved engagement faces of the upper and lower sealing assemblies 93 and 94 not only stretch and flatten the film tube web it is sealed but also snug and tighten the film around the article being packaged. In particular, the perpendicular width of the engagement surfaces of the assemblies is reduced. Secondly, the curved surfaces in stretching the film prior to forming the seal allows it to elastically spring back bringing the seal closer to the article being packaged. Finally, the configuration of the sealing wire cavity in the lower sealing assembly tends to focus heat at the slot aperture which causes further elastic shrinkage of the seal towards the article being package/bagged.

The invented automatic packaging machine has been described in context of a preferred and exemplary embodiment. Many variations, substitutions and modifications can be made to the invented machine including altering absolute or relative dimensions of parts, materials used and the manner advancing the film web through the machine, and the particular algorithms, programs, or instructions for the microprocessor without departing from the spirit and the scope of the invention as set in the appended claims.

We claim:

1. A machine for automatically bagging articles within a thermoplastic film comprising in combination, a first tracking means following a web of the thermoplastic film as it moves longitudinally for generating a signal pulse for each unit length of film web moving by a reference position, a folding plane means for folding the web longitudinally aligning its side edges together, the articles being serially introduced into a volume partially enclosed by the longitudinally folded web, a continuous side sealing means receiving the aligned side edges of the web for intermittently advancing the folded web longitudinally while sealing the edges of the advancing web together forming a longitudinal film tube enclosing the articles, a cycling transverse sealing means moving with the tube as it intermittently advances longitudinally for sequentially engaging, sealing and severing the film web transversely between each pair of articles serially enclosed within the tube every cycle, cycle clocking means following the transverse sealing means for generating a series of signal pulses corresponding to the cycle positions of the transverse sealing mechanism, a programmable process controller means receiving the signal pulses from the first tracking means and from the clocking means for controlling the continuous side and the cycling transverse sealing means according to an algorithm relating a desired longitudinal dimension for each article containing thermoplastic film bag to a number of signal pulses received from the tracking means, and programming means for programming the programmable controller means with the desired longitudinal dimension of the article containing bag.

2. In a machine for automatically bagging articles within a thermoplastic film including folding plane means for folding a web of the film longitudinally aligning its side edges together, means for introducing articles serially into a volume partially enclosed by the folded web, a continuous side sealing means receiving the aligned side edges of the longitudinally folded web for intermittently advancing the folded web longitudinally while sealing the edges of the advancing web together to form a longitudinal film tube enclosing the serially introduced articles, a cycling transverse mechanism comprising in combination, a plurality of endless sprocket chains of identical length, a plurality of drive sprockets each having an identical number of teeth adapted to engage the sprocket chains, an upper parallel pair of shafts journalled for rotation in a frame structure, each shaft having a spaced apart pair of the drive sprockets keyed to it for carrying an upper parallel pair of the sprocket chains, a lower pair of parallel shafts journalled for rotation in the frame structure each shaft having a spaced pair of the drive sprockets keyed to it for carrying a lower parallel pair of sprocket chains, a drive gear keyed to one of the pair of lower shafts, a follower gear identical to and engaging the drive keyed to one of the upper pair of shafts, a motor coupled to and rotably driving one of the shafts whereby the upper and lower parallel pairs of sprocket chains revolve in opposite direction at the same rate, at least an upper transverse sealing bar assembly coupled to and supported between the upper parallel pair of sprocket chains, at least one lower transverse sealing bar assembly coupled to and supported between the lower parallel pair of sprocket chains positioned for synchronously engaging an upper sealing bar assembly across a plane between the upper and lower parallel pairs of sprocket chains for a period during each complete cycle of revolution of the sprocket chains, the engaging upper and lower bar assemblies transversely sandwiching the longitudinal film tube, means carried by one of the transverse sealing bar assemblies for transversely sealing the film tube sandwiched between the sealing bar assemblies, whereby the upper and lower sealing assemblies engage, move and seal the film tube as it intermittently advances longitudinally, transversely between each pair of articles serially enclosed within the tube every cycle, a cycle clocking means for generating a series of signal pulses corresponding to cycle positions of the upper and lower sealing assemblies as they revolve carried by the respective parallel pairs of sprocket chains, a programmable processor controller means receiving the signal pulses from the cycle clocking means for controlling the motor revolving the upper and lower parallel pairs of sprocket chains according to an algorithm relating a desired longitudinal dimension for each article containing thermoplastic film bag to a number of signal pulses received from the clocking means, and programming means for programming the programmable controller means with the desired longitudinal dimension for the article containing bag.

3. The machine of claim 1 wherein the cycling transverse sealing means comprises, in combination, a plurality of endless sprocket chains of identical length, a plurality of drive sprockets each having an identical number of teeth adapted to engage the sprocket chains, an upper parallel pair of shafts journaled for rotation in a frame structure, each shaft having a spaced apart pair of the drive sprockets keyed to it for carrying an upper parallel pair of the sprocket chains, a lower pair of parallel shafts journaled for rotation in the frame structure each shaft having a spaced apart pair of the drive sprockets keyed to it for carrying a lower parallel pair of sprocket chains, a drive gear keyed to one of the pair of lower shafts, a follower gear identical to and engaging the drive gear keyed to one of the upper pairs of shafts, a motor coupled to and rotably driving one of the shafts whereby the the upper and lower parallel pairs of sprocket chains revolve in opposite directions at the same rate, at least an upper transverse sealing bar assembly coupled to and supported between the upper parallel pair of sprocket chains, at least one lower transverse sealing bar assembly coupled to and supported between the lower parallel pair of sprocket chains positioned for synchronously engaging an upper sealing bar assembly across a plane between the upper and lower parallel pairs of sprocket chains for a period during each complete cycle of revolution of the sprocket chains, the engaging upper and lower bar assemblies transversely sandwiching the longitudinal film tube between them, means carried by one of the transverse sealing bar assemblies for transversly sealing the film tube sandwiched between the sealing bar assemblies, whereby the upper and lower sealing assemblies engage, move and seal the film tube as it intermittently advances longitudinally transversely between each pair of articles serially enclosed within the tube every cycle.

4. The machine of claim 1 or 2 wherein the cycle clocking means comprises in combination, follower means keyed to one of the shafts for generating a reset electrical signal pulse for every complete revolution of the shaft, an encoder wheel mechanism having a plurality of distinct magnetic field regions regularly spaced in a cylindrical ring rotatably supported in the frame structure, a stationary magnetic field sensor means positioned for sensing the ring of distinct magnetic field regions of the encoder wheel for generating an electrical current pulse corresponding to those regions as the encoder wheel rotates, mechanical means coupled to one of the shafts for rotating the encoder wheel at a known ratio relative to rotation of the sprocket and shafts carrying the sprocket chains supporting the upper and lower sealing assemblies, whereby a known number of electrical current pulses are generated for each complete cycle of the upper and lower sealing bar assemblies.

5. The machine of claim 2 futher including a tracking means following the film web as it moves into the machine for generating an electrical signal pulse for each unit length of film web moving by a reference point.

6. The machine of claim 1 or 5 wherein the tracking means comprises in combination, a rotatable length encoder wheel having a plurality of distinct magnetic field regions regularly spaced in a cylindrical ring, a stationary magnetic field sensor means for positioned for sensing the ring of distinct magnetic regions of the length encoder wheel for generating an electrical current pulse corresponding to those regions as the length encoder wheel rotates, a rotatable driver wheel engaging the film web oriented for rotating as the film web moves longitudinally into the machine, mechanical means coupling the length encoder wheel to the driver wheel for rotating the length encoder wheel at a known ratio relative to rotation of the driver wheel.

7. The machine of claim 6 futher including a training roller for training the longitudinal film web adjacent a planar surface of the folding plane means as the web unwinds from a roll of such film, and wherein the driver wheel is positioned for engaging the film web as it moves around the training roller.

8. The machine of claim 7 wherein the mechanical means coupling the length encoder wheel to the driver wheel includes isolating means for precluding reverse rotation of the length encoder wheel.

9. The machine of claim 8 wherein the mechanical means coupling the length encoder and the driver wheel comprises a common shaft, the length encoder and driver wheels being keyed to the shaft, and wherein the isolating means comprises a one way bearing secured to the machine for rotatably supporting the shaft for rotation in a forward direction and preventing rotation in a reverse direction, and futher including a resilient means for urging the driver wheel into engagement with the periphery of the training roller around which the film moves.

* * * * *